US007086376B2

(12) United States Patent
McKay

(10) Patent No.: US 7,086,376 B2
(45) Date of Patent: Aug. 8, 2006

(54) COMBINED FUEL INJECTION AND IGNITION MEANS

(75) Inventor: Michael Leonard McKay, Kardinya (AU)

(73) Assignee: Orbital Engine Company (Australia) PTY Limited, Balcatta (AU)

( * ) Notice: Subject to any disclaimer, the term of this patent is extended or adjusted under 35 U.S.C. 154(b) by 89 days.

(21) Appl. No.: 10/204,416

(22) PCT Filed: Feb. 28, 2001

(86) PCT No.: PCT/AU01/00207

§ 371 (c)(1),
(2), (4) Date: Feb. 3, 2003

(87) PCT Pub. No.: WO01/65107

PCT Pub. Date: Sep. 7, 2001

(65) Prior Publication Data

US 2003/0168038 A1 Sep. 11, 2003

(30) Foreign Application Priority Data

Feb. 28, 2000 (AU) ..... PQ5885

(51) Int. Cl.
*F02M 57/06* (2006.01)

(52) U.S. Cl. ..... 123/297

(58) Field of Classification Search ..... 123/297, 123/294, 296, 305

See application file for complete search history.

(56) References Cited

U.S. PATENT DOCUMENTS

| | | | | |
|---|---|---|---|---|
| 4,095,580 | A * | 6/1978 | Murray et al. | 123/297 |
| 4,967,708 | A * | 11/1990 | Linder et al. | 123/297 |
| 5,983,855 | A | 11/1999 | Benedikt et al. | |

FOREIGN PATENT DOCUMENTS

| | | |
|---|---|---|
| DE | 3828764 | 3/1990 |
| DE | 19828849 | 12/1999 |
| GB | 2057054 | 3/1981 |
| GB | 2311327 | 9/1997 |
| JP | 08074703 | 3/1996 |
| JP | 08100738 | 4/1996 |

* cited by examiner

*Primary Examiner*—Thomas Moulis
(74) *Attorney, Agent, or Firm*—Rothwell, Figg, Ernst & Manbeck

(57) ABSTRACT

A device (10) providing a combined fuel injection and ignition means for a spark-ignition internal combustion engine. The device (10) comprises a insulator body (25) of ceramic material, a fuel flow path (24) having a section thereof encased in the insulator body (25) and terminating at a delivery port (45) disposed outwardly of the insulator body (25), and, an ignition path (23) having a section encased in the insulator body (25) in a spaced apart relationship with respect to the section of the fuel path (24). The fuel path (24) is defined within a valve structure (33) detachably secured to the insulator body (25) so as to be selectively removable therefrom. The ignition path (23) terminates at an electrode (95) disposed outwardly of the insulator body (25). The insulator body has a nose portion (100) and a skirt portion (69) beyond the delivery port (45). The nose (100) and the delivery port (45) are positioned relative to each other such that all or at least part of the fuel spray issuing from the delivery port (45) avoids impingement on the nose (100).

58 Claims, 6 Drawing Sheets

COMBINED FUEL INJECTION AND IGNITION MEANS

TECHNICAL FIELD

This invention relates to a combined fuel injection and ignition means for a spark-ignition internal combustion engine.

BACKGROUND OF THE INVENTION

Combined fuel and ignition means for spark-ignition internal combustion engines are known. Typical examples of arrangements involving combined fuel injection and ignition means are disclosed in U.S. Pat. No. 4,967,708 (Linder et al), EP 0 632 198 (Suzuki), U.S. Pat. No. 5,497,744 (Nagaosa et al), and U.S. Pat. No. 5,730,100 (Bergsten).

In each of these arrangements, the fuel and high voltage ignition follow a common path through the device. Typically, fuel is delivered through a fuel delivery port defined between a valve seat and a valve needle. The valve needle is of electrically conductive material so as to provide the ignition path. This arrangement thus provides the common path for the fuel and the high voltage energy.

In such devices the valve stem is believed to provide relatively high levels of capacitance within the ignition circuit. This can lead to high level of electrical noise radiating from such devices. In some arrangements there can also be secondary sparking that occurs between the moving components of the valve needle during ignition.

SUMMARY OF THE INVENTION

According to one aspect of the invention there is provided a combined fuel injection and ignition means for a spark-ignition internal combustion engine, comprising a fuel flow path and an ignition path located in a spaced apart relationship.

Locating the ignition path and the fuel flow path in a spaced apart relationship enables a fuel charge and an ignition current to be delivered to a combustion chamber independently of each other. Preferably said ignition path further comprises a resistive element or a reactive element located in close proximity to a primary electrode of the device whereby the rate of discharge of current from the ignition circuit is controlled.

The primary electrode is typically an emitter electrode connected with an ignition coil or similar high voltage generating means. The primary electrode is typically isolated electrically from the remainder of the combined fuel injection and ignition means by insulating means. Accordingly the primary electrode is particularly suitable for locating the resistive element, as the insulating means can act to contain the ignition current so that the current is forced to flow through the resistive element; that is, the insulating means reduces the ability of the ignition current to follow a short circuit path around the resistive element. Where a resistive element is located in an electrical path to ground potential (ie on the ground side of the spark gap) it has been found by the applicant that it is difficult to ensure that the ignition current passes through this resistive element. Commonly, the current will attempt to track along the outside of any insulation that is provided around the outside of such a resistive element located on the ground side of the spark gap. Providing an insulated ground path of extended length has been found as a suitable solution to this problem, however this often makes the combined injection and ignition device difficult to construct. Accordingly, in a combined injection and ignition device, the injector can be seen as being particularly suited to forming a secondary electrode. In this regard the injector is preferably constructed so as to form a path to ground via any mechanical arrangement, such as a threaded collar, used for securing the combined ignition and injection device into the cylinder head or cylinder block of the engine. In this regard, the current may pass through a leg of the injector to the mechanical arrangement. Alternatively, the current may return to ground using the injector leg and passing through the solenoid used for actuating the injector.

Preferably, at least a section of the fuel flow path and at least a section of the ignition path are generally parallel. Preferably said generally parallel paths are generally parallel to an axis of said combined fuel injection and ignition means.

Preferably said fuel flow path and said ignition means are electrically isolated by an insulator defining said insulating means. Preferably said fuel flow path and said ignition path are located within a common insulating body defining the insulator.

Preferably, the insulator further provides thermal insulation to at least said fuel flow path. Preferably said insulator is formed of ceramic material so as to provide both said electrical and said thermal insulating properties.

Preferably, the fuel flow path terminates at a delivery port disposed outwardly of the insulator body.

Preferably, the ignition path terminates at an electrode disposed outwardly of the insulator.

The electrode may constitute a primary electrode which co-operates with a secondary electrode to define a spark gap therebetween. The secondary electrode preferably comprises the injector.

The primary electrode may have an inner axial section and an outer lateral section which extends towards the secondary electrode. The primary electrode may further include intermediate section which provides a curved transition between the inner and outer sections. In this way, the primary electrode has a curved configuration which extends towards, and terminates short of, the secondary electrode so that the spark gap is defined between the two electrodes.

The body preferably includes a first projection defining a nose beyond which the electrode extends. Typically, the nose is disposed about the inner axial section of the primary electrode.

Preferably, the body includes a second projection defining a skirt portion beyond which the delivery port extends.

The fuel flow path may be defined within a valve structure supported in the insulator. Conveniently, the valve structure is detachably secured to the insulator so as to be selectively removable therefrom. Typically, the valve structure is detachably secured to the insulator by being threadedly engaged therewith.

The valve structure may comprise a valve needle having a valve head and a valve housing of tubular construction having an intake end and a delivery end, the delivery end of the valve structure defining a valve seat for co-operation with the valve head to define the delivery port. The valve head may be provided with an outwardly extending axial projection which may be utilised as the secondary electrode. The projection may also be utilised to provide a fuel spray guidance (or spray shaping) effect such as described in U.S. Pat. No. 5,551,638. Although such a projection is preferred it is not essential as a leg of the injector may also act as a secondary electrode as may the valve head.

The spark gap is preferably positioned within the path of such a fuel spray issuing from the valve head. In this way, a spark breaching the spark gap can directly ignite spray that has issued from the valve head. Preferably the spray issuing from the valve head penetrates the combustion chamber at a rate sufficient for the spark gap to still be in the path of the spray once the valve head has closed or commenced closing.

Typically, the valve housing incorporates a threaded formation for threaded engagement between the valve structure and the valve body.

The fuel flow path may be a single fuel path, or a dual fluid path wherein both fuel and a second fluid are delivered by the combined fuel injection and ignition means to the engine. Where a single fuel path is provided, said single fuel path is preferably a pressurised fuel path. Where a dual fluid path is provided, said second fluid is preferably a compressible fluid and is more preferably compressed air and said fuel is preferably pressurised.

According to a second aspect of the invention there is provided a combined fuel injection and ignition means for a spark-ignition internal combustion engine, comprising an insulator, a fuel flow path having a section thereof encased in the insulator body, the fuel flow path being defined within a valve structure detachably secured to the insulator so as to be selectively removable therefrom.

Typically, the valve structure is detachably secured to the insulator by being threadedly engaged therewith.

Preferably, the fuel flow path terminates at a delivery port disposed outwardly of the insulator.

Preferably, the body includes a projection defining a skirt portion beyond which the delivery port extends.

According to a third aspect of the invention there is provided a combined fuel injection and ignition means for a spark-ignition internal combustion engine, comprising an insulator, an ignition path having a section thereof encased in the insulator, the ignition path terminating at an electrode disposed outwardly of the insulator, the electrode having an inner axial section, an outer lateral section which extends towards a further electrode, and an intermediate section which provides a curved transition between the inner and outer sections.

In this way, the electrode has a curved configuration which extends inwardly towards, and terminates short of, the further electrode so that a spark gap is defined between the two electrodes.

The insulator preferably includes a projection portion defining a nose beyond which the electrode extends. Typically, the nose is disposed about the inner axial section of the primary electrode.

According to a fourth aspect of the invention there is provided a combined fuel injection and ignition means for a spark-ignition internal combustion engine, comprising a insulating body of ceramic material, a fuel flow path having a section thereof encased in the insulator body and terminating at a delivery port disposed outwardly of the insulator body, an ignition path having a section thereof encased in the insulator body in a spaced apart relationship with respect to the section of the fuel flow path, the fuel flow path being defined within a valve structure detachably secured to the insulator body so as to be selectively removable therefrom, the ignition path terminating at an electrode disposed outwardly of the insulator body, the electrode having an inner axial section, an outer lateral section which extends towards a further electrode, and an intermediate section which provides a curved transition between the inner and outer sections, the body having a projection portion defining a nose beyond which the electrode extends, and the body having a further projection defining a skirt portion beyond which the delivery port extends.

Preferably said projections are arranged so as to allow all or at least part of a spray that, in use, issues from said delivery port from impinging on said nose whilst directing at least part of the spray into the vicinity of a gap between said electrodes.

Although it is preferable to prevent impingement of fuel spray onto the nose of the insulator it is also preferable that at least part of inner axial portion of the primary electrode that extends beyond the nose of the insulator be located within the fuel spray so that the spray can cool the electrode.

According to a fifth aspect of the present invention there is provided a combined fuel injection and ignition means for a spark ignited internal combustion engine comprising a fuel delivery path for delivering fuel to a delivery valve and an ignition path for supplying electrical current to a first electrode of an ignition means; said delivery valve adapted to, in use, shape fuel spray issuing therefrom whereby said fuel spray avoids direct impingement on a first portion of said ignition path and said fuel spray is at least directed into an immediate vicinity of a second portion of said ignition path.

It is preferable that said first portion of said ignition path comprises a first member surrounding said ignition path and said second portion comprises a distal end portion of an electrode extending from said first member.

Preferably said fuel path and said ignition path are located in a spaced apart relationship. Preferably said fuel path is at least partially located in a second member; said second member terminating adjacent said valve means; said first and second members providing electrical insulation between said fuel path and said ignition path; said first and second members defining an isolation path therebetween of sufficient distance to prevent electrical shorting between said ignition path and said fuel path when, in use, said ignition path is at a voltage below a pre-determined voltage. Preferably fuel path and said ignition path are located in a common member. The common member may comprise an insulating body of ceramic material.

Preferably said device is arranged such that, in use, at least a portion of said fuel path and at least a portion of said ignition path project into a combustion chamber of a spark ignited internal combustion engine; said second member further operating to thermally insulate said fuel path from combustion temperatures.

Preferably said isolation path projects internally to said common member. Preferably said isolation path forms a generally elongate surface projecting internally to said common member to define a space, said space being of greater dielectric resistance than the distance between said valve and said distal end portion of said electrode.

According to a sixth aspect of the present invention there is provided a combined fuel injection and ignition means for a spark-ignition internal combustion engine; said combined fuel injection and ignition means comprising a fuel flow path with a delivery valve at a distal end thereof and an ignition path with a terminal member at a distal end thereof; said fuel flow path and said ignition path located in spaced apart relationship and at least a portion of said ignition path being electrically insulated from said fuel flow path; said combined fuel injection and ignition means adapted such that, in use, at least a portion of said ignition path projects internally of said combustion chamber a length sufficient to prevent shorting of electrical energy between said ignition path and a cylinder head of said engine.

Preferably said delivery valve of said fuel flow path projects internally of said combustion chamber whereby a distal end of said delivery valve operates as a secondary electrode; at least a portion of said fuel flow path being insulated so as to define a surface extending between said terminal of said ignition path and said delivery valve of said fuel flow path; said surface having a length of greater dielectric resistance than a spark gap between said primary electrode and said secondary electrode.

According to a further aspect of the present invention there is provided a spark ignition internal combustion engine comprising a combined fuel injector and ignition means as defined in any one of aspects one to six detailed above and which may additionally include any of the preferred features detailed above.

BRIEF DESCRIPTION OF THE DRAWINGS

Preferred embodiments of the invention shall now be described, by way of example only, and with reference to the accompanying drawings in which.

BEST MODE(S) FOR CARRYING OUT THE INVENTION

Figure 1:
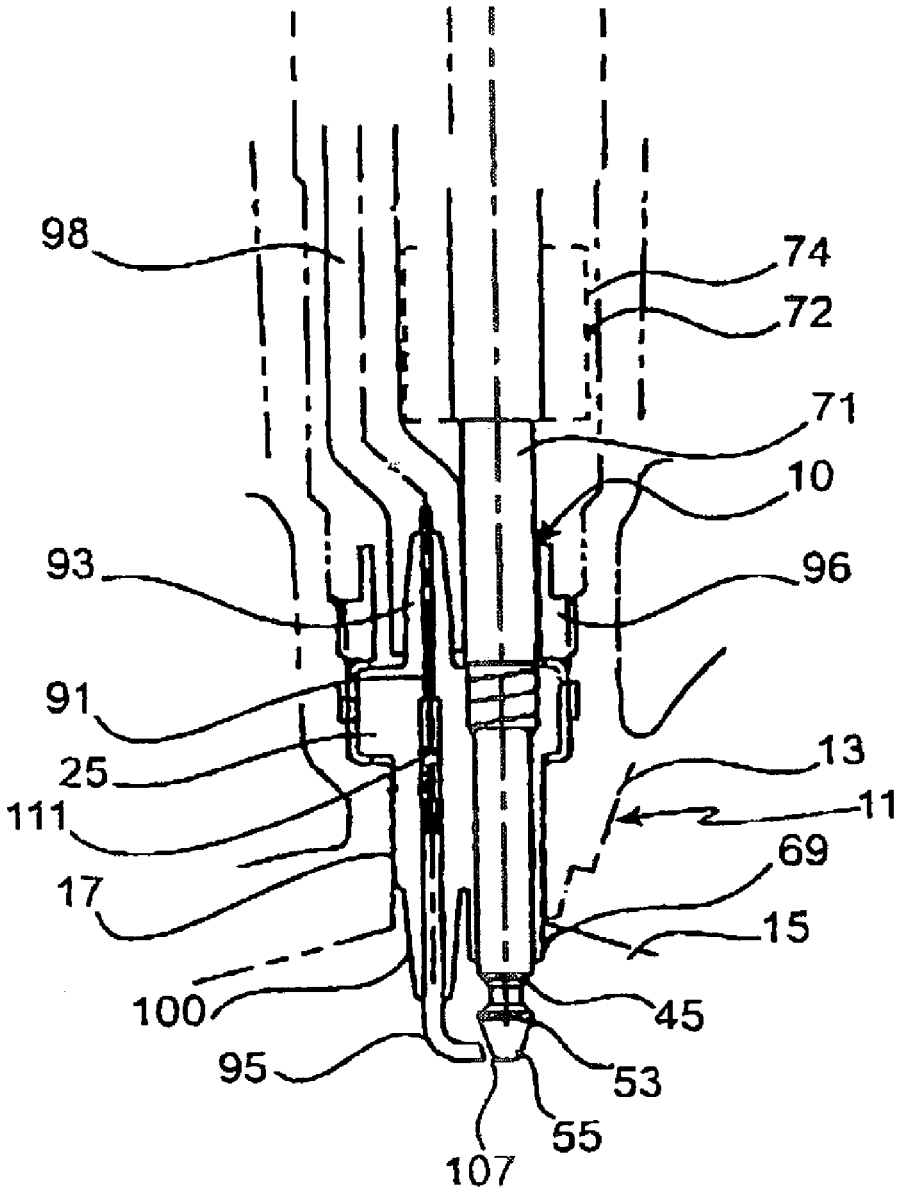
FIG. 1 is a sectional view of combined fuel injector and ignition device installed in a cylinder head of an internal combustion engine.
Figure 2:
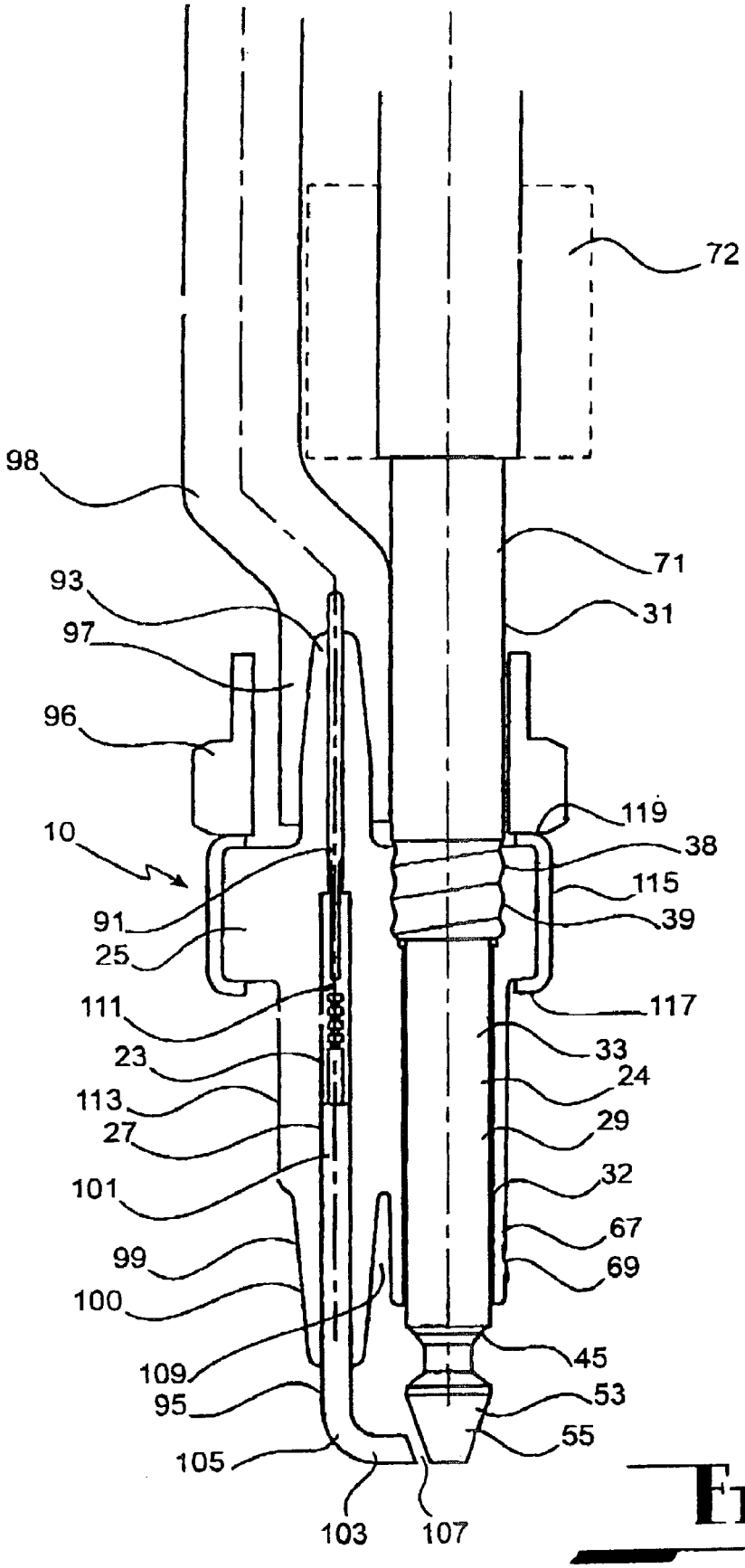
FIG. 2 is a sectional view of the combined fuel injector and ignition device of FIG. 1 in an assembled form.
Figure 3:
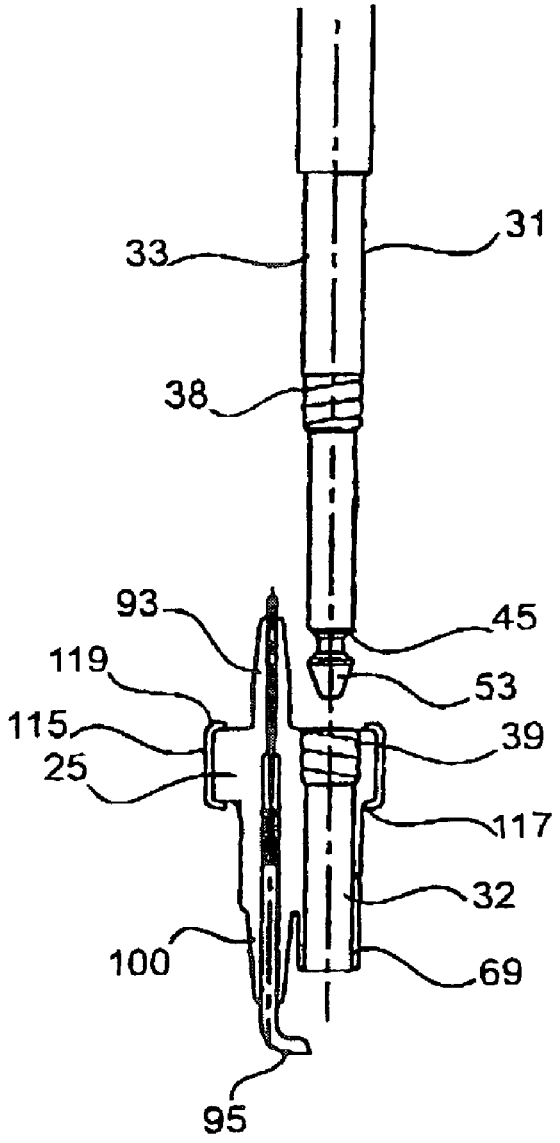
FIG. 3 is a sectional view of component elements in disassembled form of the combined fuel injector and ignition device of FIG. 1.
Figure 4:
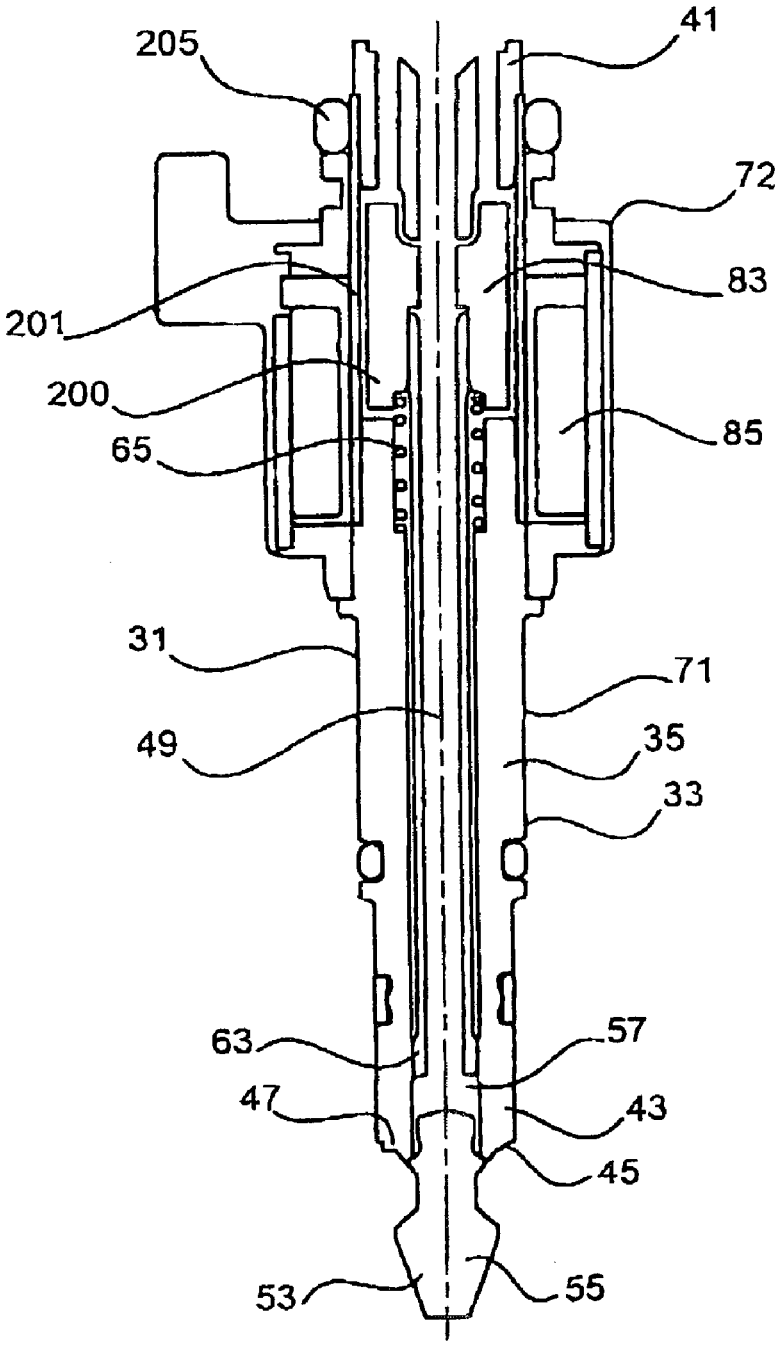
FIG. 4 is a sectional view of the fuel injector aspects of the combined fuel injector and ignition device of FIG. 1.
Figure 5:
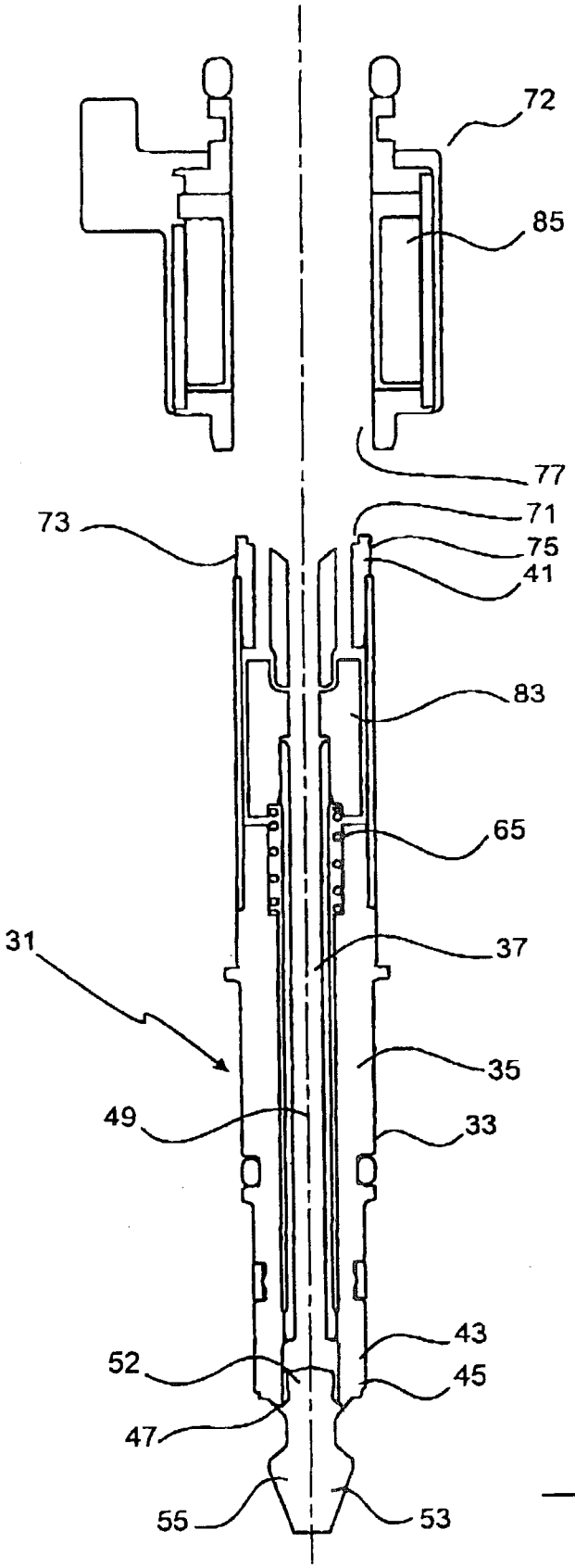
FIG. 5 is a sectional view of component aspects in disassembled form of the fuel injector of FIG. 4.

Referring to the drawings, a device 10 according to the embodiment provides a combined fuel injection and ignition means for a reciprocating piston internal combustion engine. The device 10 is equally applicable to two and four stroke engines.

The device 10 is also applicable to various forms of direct injection internal combustion engines, such as High Pressure Direct Injection engines, dual fluid injection engines (often referred to as gas assisted (or air assisted) direct injection engines) and other forms of direct injection engines.

The device 10 has particular application to combined fuel injection and ignition devices for spark ignited internal combustion engines that ignite fuel as it is delivered from a fuel delivery valve (or immediately after cessation of fuel delivery from a fuel delivery valve) of the device 10. Certain forms of such devices are referred to jet ignited or spray guided injectors.

In this embodiment, the device 10 will be described in relation to an engine 11 having a cylinder head 13 co-operating with a engine block (not shown) to define a combustion chamber 15 into which fuel is delivered by way of a direct injection process using the device 10. The cylinder head 13 incorporates a bore 17 into which the device is to be secured, as will be explained later. While the description refers only to one cylinder of the engine, it is to be appreciated that the engine may be either a single-cylinder engine or a multi-cylinder engine in which one device 10 is associated with each combustion chamber.

The device 10 has a high voltage current path 23 along which it selectively delivers high voltage ignition energy. Such a high voltage current path 23 may be referred to as an ignition path. The device 10 also has a fuel flow path 24 along which fuel is delivered. Both the fuel flow path 24 and the high voltage current path 23 operate in timed sequence with operation of the engine. The fuel flow path 24 and the high voltage current path 23 are located separately of each other in device 10, preferably with their respective axis in a generally parallel arrangement. The axis of the fuel flow path and the ignition path may also be located in an arrangement that is parallel with the axis of the device 10. Further the fuel flow path 24 may form an element of a fuel delivery means within the device 10. Similarly the high voltage current path 23 may form an element of an ignition means within device 10. Such fuel delivery means and ignition means may be located separately within the device in a spaced apart relationship, preferably with their axis in a generally parallel arrangement.

In a preferred embodiment, the device 10 operates with a so-called dual fluid injection system involving delivery of fuel by entrainment in a second fluid, such as a gas. Typically, this second fluid is compressed air which operates as a propellant to assist with delivery of the fuel from the device 10. In a direct injection system, this delivery occurs into the combustion chamber 15. While fuel can be entrained in the second fluid in any suitable way, it is particularly convenient to utilise the features of the fuel injection apparatus disclosed in U.S. Pat. No. 4,693, 224 which has been assigned to the Applicant and the contents of which are incorporated herein by way of reference. Furthermore, while this embodiment is described in respect of a dual fluid injection system, it is to be appreciated that the device 10, with suitable construction of the delivery injector, as is well know in the art, may operate in conjunction with a single fluid fuel injection system.

In the present embodiment the device 10 comprises an insulator body 25 that provides both electrical and thermal insulation to the current path 23 and the fuel flow path 24. Preferably the insulator body 25 is formed as a single piece of a ceramic material, such as for example, Alumina. It should be appreciated that other suitable forms of electrical insulation and/or thermal insulation may be adopted. In particular, separate insulating bodies may be provided for the current path 23 and the fuel flow path 24. The high voltage current path 23 has a section 27 thereof encased in the insulator body 25. The fuel flow path 24 also has a section 29 thereof encased in the insulator body 25. The two path sections 27,29 are in a spaced apart relationship with respect to each other in the insulator body 25 so as to be both electrically and thermally insulated from each other. It is preferable that insulator body 25 provides thermal insulating characteristics that are sufficient to insulate the section 29 of the fuel flow path 24 located within the insulator body 25 from the thermal effects of combustion of fuel in the combustion chamber 15. This is particularly so where some, or all, of the section 29 of the fuel flow path 24 projects beyond the cylinder head 13 so as to be located internally to the combustion chamber 15. In such an embodiment these thermal insulating characteristics of the insulator body 25 reduce (and preferably eliminate) the effects of carbonisation and polymerisation of fuel that may occur in the section 29 of the fuel flow path 24.

The fuel flow path 24 is defined within an injector leg 31 extending through and supported within a first passage 32 in the insulator body 25. The injector leg 31 comprises a valve structure 33 which includes a valve housing 35 of tubular construction and a valve needle 37 accommodated within the valve housing 35. The valve housing 35 incorporates a male threaded formation 38 on the exterior surface thereof for threaded engagement with a complementary female threaded formation 39 provided in the first passage 32. The threaded engagement between the injector leg 31 and the insulator body 25 provides a detachable connection therebetween which allows the two parts to be separated as required for servicing, repair or replacement. While in this embodiment the detachable connection between the injector leg 31 and the insulator body 25 has been described and illustrated as a threaded connection, it will be appreciated that other connection arrangements (either permanent or detachable) are possible. For example, a friction connection may be possible utilising a snug fit between the valve housing 35 and passage 32 within the insulator body 25 in which it is received. Alternatively, an axial clamp which may force engagement between insulator body 25 and valve housing 35 may also be used.

The valve housing 35 has an intake end 41 through which fuel enters the device 10 and, in a dual fluid embodiment, through which this fuel communicates with a second fluid, such as compressed gas. The valve housing 35 has a delivery end 43 co-operating with the valve needle 37 to define a delivery port 45 at which the fuel flow path terminates and through which the fuel issues (entrained in the second fluid), as a spray into the combustion chamber 15. The delivery end 43 incorporates a valve seat 47.

The valve needle 37 is of the outwardly-opening poppet valve type having a valve stem 49 and a valve head 51 at one end of the valve stem. The valve head 51 has a sealing face movable into and out of engagement with the valve seat 47 for opening and closing the delivery port 45. An outwardly extending axial projection 53 is provided on the valve head 51. The projection 53 may be utilised as a secondary electrode 55 in the high voltage ignition circuit incorporated into the device as will be described in detail later. The projection 53 may also be utilised to provide a fuel spray guidance affect, as disclosed in U.S. Pat. No. 5,551,638 which has been assigned to the Applicant and the contents of which are incorporated herein by way of reference. Preferably the delivery port 45 is arranged to ensure that the fuel spray does not impinge directly on the insulator body 25 as it exits the delivery port 45. The delivery port may be co-operatively associated with projection 53 to shape the spray issuing from delivery port 45 to prevent the spray from impinging directly on the insulator body 25. The spray may also be shaped so that it is directed into the vicinity of at least one electrode on device 10 so as to be in the vicinity of a spark gap so as to facilitate ignition of the spray—such an arrangement being commonly referred to as "spray guided". Directing the spray to the electrode may also provide a cooling effect to the electrode and thereby preferably keep the electrode at an average temperature of approximately 750° C.

In locating the primary electrode 95 and associated nose 100 relative to the exit point of the fuel spray from the injector, allowance should preferably be made of the included angle of the spray. For a dual fluid embodiment this angle may be in the vicinity of 110°. It has generally been found to be preferable to locate the spark gap down stream of the exit point of the spray from the injector so that the fuel spray can be ignited in the vicinity of the fuel injector. Causing the fuel injector to be a secondary electrode can assist with ensuring reliable and repeatable combustion. In arrangements where the spark gap is located down stream of the exit point of the fuel spray from the exit point of the fuel injector it is generally possible to locate the terminal portion of the nose 100 surrounding the primary electrode 95 at a point that is down stream of a horizontal plane passing through the exit point of the spray from the injector without the spray impinging on the nose 100 so long as the included angle of the spray is less than 180°.

While the embodiment has been described and illustrated utilising an outwardly opening poppet type valve (which is particularly suited to a combined fuel injection and ignition means), it is to be appreciated that other valve constructions may be utilised, such as for example, an inwardly opening or pintle type valve.

In a dual fluid embodiment, the valve stem 49 is preferably of hollow construction to provide a central bore which forms part of the fuel flow path 24. Openings are provided in the wall of the valve stem 49 to permit the fuel and compressed gas to pass from the central bore to an outer zone of the delivery end 43 from where it can be delivered into the combustion chamber 15 upon opening of the delivery port 45. Such a hollow valve stem 49 is disclosed in the U.S. Pat. No. 4,934,329 which has been assigned to the Applicant and the contents of which are incorporated herein by way of reference.

The valve stem 49 has a first guide (or bearing) portion 63 which is axially slidable within the central bore 57 in the valve housing 35 for guiding axial movement of the valve needle 37, and hence the valve head 51 as it moves into and out of sealing engagement with the valve seat 47. A second guide portion 200 is axially slidable within sleeve 201, so as to form a second bearing for valve needle 37. A valve control spring 65 is provided to bias the valve needle 37 into a condition in which the valve head 51 is in sealing engagement with the valve seat 47, thereby closing the delivery port 45.

The delivery port 45, which is the location at which the fuel flow path 24 terminates, is disposed slightly outwardly of the insulator body 25, as shown in the drawings. More particularly, the insulator body 25 includes a projection 67 which defines a skirt 69 beyond which the delivery port 45 is located. With this arrangement, the skirt 69 electrically and thermally insulates the region of the injector leg 31 closely adjacent the delivery port 45 without impeding operation of the delivery port. The feature of thermal insulation is particularly beneficial as it serves to resist charring temperatures in the injector leg 31. It is important to avoid charring due to a portion of the injector leg 31 being exposed to the combustion chamber. Such charring may impede detachment of the injector leg 31 from the insulator body 25 or may result in seizure of the valve. The thermal insulating effects, as detailed above, assist with reducing, or preventing, the effects of charring of fuel that may be caused within injector leg 31 due to overheating of fuel contained in the injector leg. Thermal insulating may also provide the additional advantages of maintaining the surfaces of the skirt 69 and nose 100 at high temperatures in the combustion chamber, thus preventing electrically conductive deposits forming which may prevent ignition occurring due to electrical energy shorting to ground across the surface deposits.

An air gap 102 is preferably provided intermediate the insulator body 25 and the injector leg 31. This air gap 102 serves to further insulate the injector leg 31 from the relatively hotter surfaces of the skirt 69.

The air gap 102 is preferably such that the injector leg 31 surrounded by the skirt 69 is in communication with the gasses of the combustion chamber. This helps to prevent carbon build up within the air gap as the combustion chamber gasses cause the carbon to oxidise. If the gap 102 is too narrow then an insufficient amount of gas penetrates the air gap and carbon deposits build up. If the gap 102 is too wide then the skirt 69 provides insufficient thermal insulating properties. Some carbon will build up within the air gap 102. At the terminal point of the air gap 102, where the insulating body 25 comes into contact with the injector leg 31, a small amount of carbon deposit can build up. The air gap 102 needs to be relatively longer than the length of carbon deposits that arise in operation. For example, the air gap 102 may project internally to the skirt 69 beyond the point where the outer surface of the skirt intersects the lower surface of the cylinder head 13. It will be noted that the lower surface of the cylinder head 13 defines the upper surface of the combustion chamber.

A preferred feature of the present embodiment is the injector leg 31 defining a first part 71 of the fuel delivery system for the device 10. The fuel delivery system further includes a second part 72 which is adapted to be releasably connected to the first part 71 to provide an operating assembly. The second part 72 is in the form of a demountable sleeve 74 which is adapted to fit onto the injector leg 31.

An actuating means 81 is provided for selectively moving the valve needle 37 against the bias of the valve control spring 65 out of sealing engagement with the valve seat 47, thereby opening the delivery port 45. The actuating means 81 comprises first and second actuating elements 83, 85 that are co-operatively associated. The first actuating element 83 is mounted on the valve needle 37 within the first part 71, and the second actuating element 85 is provided on the second part 72 such that when the first and second parts 71, 72 are brought together as an operating assembly, the first and second actuating elements 83 and 85 are operably associated. In this embodiment, the actuating means operates electromagnetically, with the first actuating element 83 being a solenoid armature and the second actuating element 85 being a solenoid coil. When the two parts 71,72 are connected together to provide the operating assembly, the solenoid coil is disposed concentrically about the solenoid armature so that energisation of the solenoid coil induces movement of the valve needle 37 against the influence of the valve control spring 65 so as to open the delivery port 45. The actuating means is similar to the arrangement disclosed in the Applicant's International Application PCT/AU00/01267, the contents of which are incorporated herein by way of reference.

The intake end 41 of the valve housing 35 incorporates a terminal portion 73 having a male connector 75 which is adapted to engage with a complimentary female connector 77 in the second part 72. The second part 72 has a fuel delivery means (not shown), such as a fuel metering device, which communicates with the fuel flow path 24 in the injector leg 31 when the first and second parts 71, 72 are connected together for delivery of fuel and gas to the injector leg. A sealing ring 205 is preferably used to seal fluids within sleeve 201 and an external metering device and gas supply means (not shown).

As mentioned previously, the high voltage current path 23 includes a section 27 thereof encased in the insulator body 25 electrically and thermally insulated from the injector leg 31. The current path 23 includes a wire conductor 91 which extends between a high tension terminal stud 93 mounted on the insulator body 25 and a primary electrode 95 also mounted on the insulator body 25.

The high tension terminal stud 93 is adapted for connection to a complementary female terminal member 97 at one end of a high tension lead 98. The female terminal member 97 is adapted to be detachably mounted on the insulator body 25. With this arrangement, the high tension terminal stud 93 on the insulator body 25 and the female terminal member 97 are connected together for delivery of high tension power to the primary electrode 95. Apart from forming an electrical connection between terminal stud 93 and female terminal member 97, a boot on the high tension lead 98 also preferably forms an interference fit with the insulating body. The boot is preferably form of a silicon rubber with high temperature stability and high dielectric strength so as to form a good electrical shield for the ignition circuit.

The insulator body 25 includes a projection 99 defining an insulator nose 100 beyond which the primary electrode 95 extends. The nose 100 of the insulator body preferably projects into the combustion chamber. The axial length of this nose 100 relative to the point of contact of the nose 100 and the cylinder head 13 is sufficient to prevent surface tracking of electrical energy between the cylinder head 13 (which is typically at ground potential) and the primary electrode. This length also assists with maintaining the surface temperature of the nose 100 at a high enough level to prevent conductive deposits forming on the surface. The primary electrode 95 has an inner axial section 101, an outer lateral section 103 which extends towards a secondary electrode 55 which in the present embodiment is defined by the projection 53. Where the injector leg 31 or a part thereof such as projection 53 forms the secondary electrode 55, the primary electrode 95 preferably comprises an intermediate section 105 which provides a curved transition between the inner and outer sections 101, 103. In this way, the primary electrode 95 has a curved configuration which extends inwardly towards, and terminates short of, the secondary electrode 55 so that a spark gap 107 is defined between the two electrodes. The insulator nose 100 is disposed about the inner axial section 101 of the primary electrode 95, with the curved intermediate section 105 and the outer lateral section 103 being located beyond the insulator nose. The curved configuration of the primary electrode 95 is advantageous in several respects. First, the curved configuration can prevent the insulator nose 100, or a portion thereof, from falling into the combustion chamber 15 if it fractures. In the event of such a fracture, the detached part of the insulator nose is caught and retained by the curved primary electrode 95 before it can fall into the combustion chamber. A second advantage of the curved configuration of the primary electrode 95 is that it can prevent a detached part of the valve needle 37 from falling into the combustion chamber 15 should it fracture or decouple from the valve stem 49. In the event of such a fracture or decoupling, the outer lateral section 103 of the primary electrode 95 blocks the path of the detached part of the valve needle to prevent it from falling into the combustion chamber.

A preferred feature of the present embodiment is that the nose 100 and skirt 69 together define an elongate external boundary of the insulator body 25 at the point where the insulator body 25 projects into the combustion chamber from the cylinder head. This elongate boundary can provide indexing to the combined ignition and injection device so as to ensure that the device can only assume certain orientations within the combustion chamber and preferably only assume one orientation.

The curved configuration of the primary electrode 95, together with the separation of the high voltage current path 23 and the fuel flow path 24, allows the size of the spark gap 107 to be optimally controlled in the manufacturing process. This is particularly advantageous in terms of the performance of the device and can be difficult to achieve in prior art devices which utilise a common path.

Figure 6:
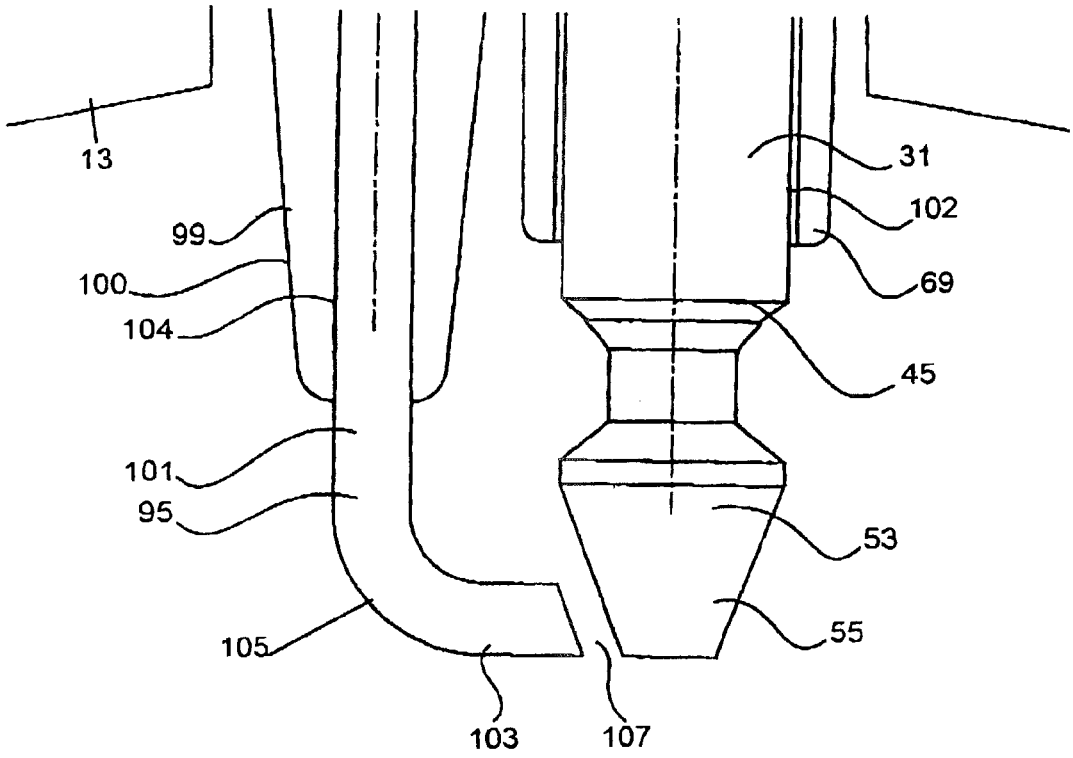
FIG. 6 is an enlarged view of part of the combined fuel injector and injection device.

It is preferable that an air gap 104 is located on the nose 100, in similar fashion to the air gap 102 about the injector leg 31. It has been found that the air gap 102 of the skirt 69 around the injector 31 needs to be wider than the air gap of the nose 100 around the primary electrode. The air gap 104 is not readily apparent in the drawings in relation to the air gap 102 including FIG. 6 because of its small size. It is also preferable that the air gaps on both the nose 100 and the skirt 69 are of a generally constant distance from the outer surface of the primary electrode and the injector leg 31 respectively.

Because the high voltage current path 23 and the fuel flow path 24 are spaced apart and generally parallel in their extent through the insulator body 25, the skirt 69 and the nose 100 are disposed in a spaced apart side-by-side relationship with a space 109 therebetween. The separation between the two paths 23, 24 in the insulator body 25, and their encasement in the insulator body 25, allows optimal location of the delivery port 45 in the injector leg 31 with respect to the primary electrode 95. Optimal location may provide that fuel spray from delivery port 45 impinges on the primary electrode or is delivered into the immediate vicinity of the primary electrode so that the fuel plume from the delivery port may be ignited by a spark issuing from the primary electrode immediately after the delivery port closes and in certain applications whilst the delivery port 45 is open. Optimal delivery of fuel also prevents fuel from impinging directly onto insulating body 25. Furthermore, the separation of the ignition path 23 from the fuel path 24 enables a resistive element to be readily included within ignition path 23. Such a resistive element helps to reduce the rate of current discharge across the spark gap compared with a system that does not incorporate a resistive element within the ignition path 23. Reducing the rate of current discharge within a combined injection and ignition device assists with reducing the level of electromagnetic emissions and arcing that may be developed within the injector leg 31. High levels of electromagnetic interference can affect the good working and operation of the engine control unit (ECU) and high levels of arcing is most undesirable as it could cause welding between metal surfaces in the injector leg. Arcing is a common occurrence in prior art devices employing a common path for injected fuel and high voltage ignition energy.

The surface along the insulator body between the nose 100 and the skirt 69 that defines an edge of the space 109 operates to effectively increase the distance that a spark must travel for it to jump from the primary electrode 95 to the secondary electrode 55. Increasing this distance increases the electrical insulating effect provided by the insulator body 25. This reduces the likelihood of uncontrolled or unintentional sparking across the primary and secondary electrodes compared with an embodiment absent of such space 109. The resistance provided by this surface is greater than the resistance provided by the air gap between the primary and the secondary electrode. It is believed that a spark can jump along such surface more readily than across an air gap. Accordingly this path is longer than the air gap between the primary and secondary electrode and is also longer than if space 109 were not provided and the insulating body extended continuously between nose 100 and skirt 69.

In an alternate embodiment, the primary electrode may spark to a piston head under wide open throttle operating conditions and may spark to the secondary electrode 55 under lower load conditions. Another alternative utilises an inlet valve member on the head 13 or an exhaust valve on the head 13 to operate as a secondary electrode. Such an alternative may also spark to a piston head under wide open throttle conditions.

The high voltage current path 23 includes a resistor 111 disposed in the wire conductor 91 for the purpose of reducing the rate of change of current and voltage when an arc is struck across the spark gap 107 during an ignition event. This may be of benefit in reducing electromagnetic emissions or interference which could interfere with nearby electronic circuitry and electrical systems. Because the resistor 111 is encased in the insulator body 25, it is possible to locate it in close proximity to the spark gap 107 and thereby optimise its effectiveness. In this embodiment, the resistor 111 is in the form of a resistive glass anchor. Encasing the resistor 111 in the insulating body 25 helps to contain the ignition current thereby reducing the ability of the ignition current to follow a short circuit path around the outside of the resistor 111 as may be likely where the resistor is located within an electrical path on the ground side of the spark gap. Thus the provision of a primary electrode that is isolated from an injector enables a construction where a resistive element within the ignition path cannot be readily avoided by an ignition current.

The insulator body 25 is configured to define a male boss portion 113 which can be removably received in the bore 17 in the cylinder head 13 so as to appropriately present the delivery port 45 and the spark gap 107 to the combustion chamber 15. The male boss portion 113 may be of a size to provide a snug slip fit when inserted into the bore 17. The male boss portion 113 may be retained in sealing relationship with the cylinder head 13 by a clamping means 96 such as a threaded collar. However, other arrangements for allowing the male boss portion 113 to be received and retained in the bore 17 are possible. As discussed previously, the device 10 may be separated into component parts 71 and 72 respectively. This enables the clamping means 96 to attach the first part 71 of device 10 to the cylinder head 13 in a secure manner. The second part 72 may then be subsequently fitted to the already secured first part 71. This two part construction increases the ease with which the device 10 may be installed onto the cylinder head 13.

The insulator body 25 is fitted with a collar 115 to provide sealing washer for the device 10 when fitted in position on the engine 11. The collar 115 is typically of soft metal and defines a pair of opposed loading faces 117, 119. Face 117 is adapted to sealingly engage a marginal section of the cylinder head 13 around the bore 17 to provide a fluid-tight seal between the device 10 and the cylinder head and thereby provide a combustion seal so as to prevent combustion gasses from leaking past the combined ignition and injection device into a region external to the combustion chamber. Face 119 accommodates loading exerted on the body 25 by the clamping collar 96.

A particular benefit of the device 10 according to the embodiment arises from the use of ceramic material as a common insulator for the high voltage current path section 27 and the fuel flow path section 29. The ceramic material avoids the necessity to use plastics as insulators in critical areas as is required by prior art devices, so providing a more durable device.

The spark gap between the primary electrode 95 and the secondary electrode is preferably in the order of 1 mm. The ignition current supplied to the primary electrode 95 during a spark event is typically a peak of 100 milliamperes, reducing to zero in a linear fashion over a typical duration of 4 milliseconds. A typical ignition coil for supplying the ignition current can generate up to 40 kV during a sparking event, however voltage in the region of 15 kV to 25 kV is more typical across typical engine load ranges. The energy supplied by such an ignition coil will typically lie within the range of 15 to 100 millijoules, although a typical value is 60 millijoules.

The peak current during a spark event can be varied in order to reduce the erosion of the electrodes at the spark gap. By reducing the energy supplied to an ignition coil (by varying the duration of the current build-up in a primary winding of such an ignition coil), the peak current might typically be only 50 milliamperes, with a reduced duration of arc (say 2 milliseconds). On the other hand, where a long duration of arc is required to obtain a higher probability of ignition in a mixture with poor flammability, the energy supplied by the coil may be increased, leading to a higher peak current (say, 200 mA), with a longer duration (say 6 milliseconds).

The projection of the ceramic nose into the combustion chamber will be around 3 mm. This is the distance from the extremity of the ceramic itself from the roof of the chamber. This may vary within the range from 3 to 8 mm depending on manufacturer requirements. For example, some vehicle manufacturers require that all ignition and fuel system parts be located inside (above) the plane of a cylinder head gasket face. This projection of between 3 mm and 8 mm is to prevent ignition current shorting to the cylinder head along the ceramic of nose 100. Similarly, it is preferable that exposed portions of the ignition path and the secondary electrode by separated by at least 3 mm. This assists with promoting the development of sparking across the gap between the distal end of the primary electrode 95 and the secondary electrode. Where the secondary electrode is an injector device which has a projection on the valve head, it is possible to reduce the length of the curved portion of the primary electrode that projects toward the secondary electrode by increasing the width of this projection. Alternatively it is possible to increase the separation of the primary and fuel injector by increasing the width of the projection. In either case it is preferable that the spark gap be in the order of 1 mm.

The side clearance between the surface of the ceramic insulator nose 100 and the edge of an access hole into the combustion chamber located on a cylinder head at the plane of the combustion chamber roof preferably lies in the range of 1.5 to 2.5 mm, a typical value being 2 mm. This is to avoid tracking across the nose of the ceramic insulator directly to the cylinder head in the vicinity of the access hole.

In the embodiment described and illustrated, the section of the ignition path 23 in the insulator body 25 is generally parallel to the section of the fuel flow path 24 in the insulator body.

In another embodiment, which is not illustrated, the ignition path 23 may be angularly disposed with respect to the fuel flow path such that the primary electrode at the terminal end thereof is located in close proximity to the secondary electrode provided on the injector leg to establish the spark gap so eliminating the need for, or at least reducing the length of, the lateral portion 103 of the primary electrode 95 of the first embodiment.

From the foregoing, it is evident that the present embodiment provides a combined fuel injection and ignition means which utilises separate paths for injected fuel and ignition energy. This arrangement provides various advantages as alluded to earlier in the description of the embodiment. Furthermore, because the two paths are generally parallel and encased in a common insulator body, the device can be of a compact construction which is particularly advantageous in that it allows the device to be accommodated in the same space as other in-cylinder injectors well known in the art.

It should be appreciated that the scope of the invention is not limited to the scope of the embodiment described.

Throughout the specification, unless the context requires otherwise, the word "comprise" or variations such as "comprises" or "comprising", will be understood to imply the inclusion of a stated integer or group of integers but not the exclusion of any other integer or group of integers.

The claims defining the invention are as follows:

1. A combined fuel injection and ignition device for a spark-ignition internal combustion engine, comprising a fuel flow path and an ignition path located in a spaced apart relationship and electrically isolated with respect to each other, the ignition path terminating at a first electrode, the fuel flow path being defined within a valve structure, the valve structure defining a second electrode cooperating with the first electrode to provide a spark gap.

2. A combined fuel injection and ignition device according to claim 1 wherein at least a section of the fuel flow path and at least a section of the ignition path are generally parallel.

3. A combined fuel injection and ignition device according to claim 2 wherein said generally parallel path sections are generally parallel to an axis of said combined fuel injection and ignition device.

4. A combined fuel injection and ignition device according to claim 1 further comprising an insulator wherein said fuel flow path and said ignition path are electrically isolated by the insulator.

5. A combined fuel injection and ignition device according to claim 4 wherein said fuel flow path and said ignition path are located within a common body defining the insulator.

6. A combined fuel injection and ignition device according to claim 5 wherein the insulator further provides thermal insulation to at least said fuel flow path.

7. A combined fuel injection and ignition device according to claim 4 wherein the insulator is formed of ceramic material so as to provide both said electrical and said thermal insulating properties.

8. A combined fuel injection and ignition device according to claim 4 wherein the first electrode extends outwardly of the insulator.

9. A combined fuel injection and ignition device according to claim 8 wherein said ignition path further comprises a resistive element or a reactive element located in close proximity to the first electrode whereby the rate of discharge of current from the ignition circuit is controlled.

10. A combined fuel injection and ignition device according to claim 9 wherein the first electrode constitutes a primary electrode and wherein the second electrode constitutes a secondary electrode for providing a return to ground.

11. A combined fuel injection and ignition device according to claim 10 wherein the insulator includes a first projection and wherein the primary electrode has an inner section and an outer section which extends towards the secondary electrode, a portion of the inner section being encased in the first projection of the insulator.

12. A combined fuel injection and ignition device according to claim 11 wherein the primary electrode further includes an intermediate portion providing a curved transition between the inner and outer sections.

13. A combined fuel injection and ignition device according to claim 11 wherein the first projection defines a nose beyond which the primary electrode extends, the nose being disposed about the inner section of the primary electrode.

14. A combined fuel injection and ignition device according to claim 11 wherein an air gap is provided between the first projection and the primary electrode.

15. A combined fuel injection and ignition device according to claim 11 wherein the inner section of the primary electrode extends axially with respect to said axis of the combined fuel injection and ignition device.

16. A combined fuel injection and ignition device according to claim 15 wherein the outer section of the primary electrode extends laterally with respect to the inner section.

17. A combined fuel injection and ignition device according to claim 4 wherein the fuel flow path terminates at a delivery port defined by the valve structure, the delivery port being disposed outwardly of the insulator.

18. A combined fuel injection and ignition device according to claim 17 wherein the insulator includes a second projection defining a skirt portion beyond which the delivery port extends.

19. A combined fuel injection and ignition device according to claim 17 wherein the insulator includes a first projection encasing a portion of the first electrode, the first projection defining a nose beyond which the first electrode extends, and wherein the insulator further includes a second projection defining a skirt portion beyond which the delivery port extends, wherein the nose and delivery port are positioned relative to each other such that all or at least part of a fuel spray issuing from the delivery port avoids impingement on the nose while being directed into the vicinity of the spark gap.

20. A combined fuel injection and ignition device according to claim 11 wherein at least a portion of that part of the primary electrode extending beyond the first projection is in use located within the fuel spray so as to be cooled thereby.

21. A combined fuel injection and ignition device according to claim 4 wherein the valve structure is supported in the insulator.

22. A combined fuel injection and ignition device according to claim 21 wherein the insulator includes a projection beyond which the valve structure extends, and wherein an air gap is provided between the second projection and the valve structure.

23. A combined fuel injection and ignition device according to claim 21 wherein the valve structure is detachably secured to the insulator so as to be selectively removable therefrom.

24. A combined fuel injection and ignition device according to claim 23 wherein the valve structure is detachably secured to the insulator by being threadedly engaged therewith.

25. A combined fuel injection and ignition device according to claim 4 wherein valve structure comprises a valve needle having a valve head and a valve housing of tubular construction having an intake end and a delivery end, the delivery end of the valve structure defining a valve seat for co-operation with the valve head to define a delivery port.

26. A combined fuel injection and ignition device according to claim 25 wherein the valve head is provided with an outwardly extending axial projection.

27. A combined fuel injection and ignition device according to claim 26 wherein the axial projection provides the second.

28. A combined fuel injection and ignition device according to claim 25 wherein the axial projection provides or further provides a fuel spray guidance effect.

29. A combined fuel injection and ignition device according to claim 25 wherein the valve housing incorporates a threaded formation for threaded engagement between the valve structure and the insulator.

30. A combined fuel injection and ignition device according to claim 1 wherein the fuel flow path comprises a single fuel path.

31. A combined fuel injection and ignition device according to claim 30 wherein the single fuel path comprises a pressurised fuel path.

32. A combined fuel injection and ignition device according to claim 1 wherein the fuel flow path comprises a dual fluid path wherein both fuel and a second fluid are delivered by the combined fuel injection and ignition device to the engine.

33. A combined fuel injection and ignition device for a spark-ignition internal combustion engine, comprising an insulator, a fuel flow path having a section thereof encased in the insulator, an ignition path having a section thereof encased in the insulator, the sections of the fuel flow path and the ignition path being in spaced apart relationship and electrically isolated from each other by the insulator, the section of the fuel flow path being defined within a valve structure detachably secured to the insulator so as to be selectively removable therefrom, the ignition path terminating at a first electrode, and the valve structure defining a second electrode cooperating with the first electrode to provide a spark gap.

34. A combined fuel injection and ignition device according to claim 33 wherein the valve structure is detachably secured to the insulator by being threadedly engaged therewith.

35. A combined fuel injection and ignition device according to claim 33 wherein, the fuel flow path terminates at a delivery port disposed outwardly of the insulator.

36. A combined fuel injection and ignition device according to claim 35 wherein the insulator included a projection defining a skirt portion beyond which the delivery port extends.

37. A combined fuel injection and ignition device according to claim 33 wherein the sections of the ignition path and the fuel flow path are located within a common body defining the insulator.

38. A combined fuel injection and ignition device for a spark-ignition internal combustion engine, comprising an insulator having a projection, an ignition path having a section thereof encased in the insulator, the ignition path terminating at a first electrode extending outwardly of the insulator, the first electrode having an inner axial section and an outer lateral section which extends towards a second electrode, a portion of the inner axial section being encased in the projection, a fuel flow path defined within a valve structure supported in the insulator, the valve structure defining the second electrode which cooperates with the first electrode to define a spark gap, the sections of the fuel flow path and the ignition path being in spaced apart relationship and electrically isolated from each other by the insulator.

39. A combined fuel injection and ignition device according to claim 38 wherein the first electrode further includes an intermediate section providing a curved transition between the inner and outer sections.

40. A combined fuel injection and ignition device according to claim 38 wherein the projection defines a nose disposed about the inner axial section of the first electrode and beyond which the electrode extends.

41. A combined fuel injection and ignition means device according to claim 38 wherein the ignition path and the fuel flow path are located within a common insulator body defining the insulator.

42. A combined fuel injection and ignition device according to claim 38 wherein said ignition path further comprises a resistive element or a reactive element located in close proximity to the first electrode whereby the rate of discharge of current from the ignition circuit is controlled.

43. A combined fuel injection and ignition device according to claim 38 wherein the fuel flow path has a delivery valve adapted to deliver fuel spray in a pattern which avoids direct impingement on a first portion of said ignition path and which is at least directed into an immediate vicinity of a second portion of said ignition path.

44. A combined fuel injection device according to claim 38 wherein at least a portion of that part of the first electrode extending beyond the projection is in use located with the fuel spray so as to be cooled thereby.

45. A combined fuel injection and ignition device for a spark-ignition internal combustion engine, comprising a insulating body of ceramic material, a fuel flow path having a section thereof encased in the insulator body and terminating at a delivery port disposed outwardly of the insulator body, an ignition path having a section thereof encased in the insulator body, the sections of the fuel flow path and the ignition path being in spaced apart relationship and electrically isolated from each other by the insulator, the fuel flow path being defined within a valve structure detachably secured to the insulator body so as to be selectively removable therefrom, the ignition path terminating at a first electrode disposed outwardly of the insulator body, the electrode having an inner axial section, an outer lateral section which extends towards a second electrode, and an intermediate section which provides a curved transition between the inner and outer sections, the valve structure defining a second electrode which cooperates with the first electrode to define a spark gap, the insulator body having a projection portion defining a nose beyond which the first electrode extends, and the insulator body having a further projection defining a skirt portion beyond which the delivery port extends.

46. A combined fuel injection and ignition device according to claim 45 wherein the nose and the delivery port are positioned relative to each other such that all or at least part of a fuel spray issuing from said delivery port avoids impingement on said nose while being directed into the vicinity of the spark gap.

47. A combined fuel injection and ignition device for a spark ignited internal combustion engine comprising a fuel delivery path for delivering fuel to a delivery valve and an ignition path for supplying electrical current to a first electrode of an ignition means; the fuel flow path and the ignition path being in spaced apart relationship and electrically isolated from each other, the ignition path terminating at a first electrode; a second electrode projecting from the delivery valve in the direction of fuel spray; said delivery valve being adapted to delivery fuel spray in a pattern which avoids direct impingement on a first portion of said ignition path and which is at least directed into an immediate vicinity of a second portion of said ignition path.

48. A combined fuel injection and ignition device according to claim 47 wherein said first portion of the ignition path comprises a first member surrounding the ignition path and said second portion comprises a distal end portion of the first electrode.

49. A combined fuel injection and ignition device according to claim 48 wherein said fuel path is at least partially located in a second member, the second member terminating adjacent the delivery valve, the first and second members providing electrical insulation between the fuel path and the ignition path, the first and second members defining an isolation path therebetween of sufficient distance to prevent electrical shorting between the ignition path and the fuel supply path when, in use, said ignition path is at a voltage below a pre-determined voltage.

50. A combined fuel injection device according to claim 47 wherein the fuel flow path and the ignition path are located in a common member.

51. A combined fuel injection and ignition device according to claim 47 wherein in use, at least a portion of said fuel delivery path and at least a portion of said ignition path project into a combustion chamber of a spark ignited internal combustion engine, the second member further operating to thermally insulate said fuel supply path from combustion temperatures.

52. A combined fuel injection and ignition device according to claim 49 wherein said isolation path projects internally to said common member.

53. A combined fuel injection and ignition device according to claim 52 wherein said isolation path forms a generally elongate surface projecting internally to said common member to define a space, said space being of greater dielectric resistance than the distance between said valve and said distal end portion of said electrode.

54. A combined fuel injection and ignition device according to claim 53 wherein said path forms a generally elongate surface projecting internally to said common member to define a space, said space being of greater dielectric resistance than the distance between said valve and said distal end portion of said electrode.

55. A combined fuel injection and ignition device for a spark-ignition internal combustion engine; said combined fuel injection and ignition means comprising a fuel flow path with a delivery valve at a distal end thereof, an ignition path with a first electrode at a distal end thereof, said fuel flow path and said ignition path located in spaced apart relationship and at least a portion of said ignition path being electrically insulated from said fuel flow path, the distal end of the delivery valve providing a second electrode, the first and second electrode cooperating to define a spark gap, said combined fuel injection and ignition means being adapted such that, in use, at least a portion of said ignition path projects internally of said combustion chamber a length sufficient to prevent shorting of electrical energy between said ignition path and a cylinder head of said engine.

56. A combined fuel injection and ignition device according to claim 55 wherein the delivery valve of the fuel flow path projects internally of said combustion chamber and at least a portion of the fuel flow path is insulated so as to define a surface extending between the first electrode and the delivery valve of said fuel flow path; said surface having a length of greater dielectric resistance than the spark gap.

57. A combined fuel injection and ignition device for a spark-ignition internal combustion engine, comprising an insulator, a fuel flow path for delivering fuel to a delivery valve at a distal end thereof, and an ignition path for supplying electrical current to a first electrode of an ignition means;

wherein said fuel flow path has a section thereof encased in the insulator and said ignition path also has a section thereof encased in the insulator, the sections of the fuel flow path and the ignition path being in spaced apart relationship and electrically isolated from each other by the insulator, the fuel flow path being defined within a valve structure detachably secured to the insulator so as to be selectively removable therefrom; said delivery valve being adapted to deliver fuel spray in a pattern which avoids direct impingement on a first portion of said ignition path and which is at least directed into an immediate vicinity of a second portion of said ignition path; said delivery valve having a second electrode protecting therefrom in the direction of issuance of fuel spray; the first and second electrodes cooperating to define a spark gap; said combined fuel injection and ignition device being adapted such that, in use, at least a portion of said ignition path projects internally of said combustion chamber a length sufficient to prevent shorting of electrical energy between said ignition path and a cylinder head of said engine.

58. A combined fuel injection and ignition device for a spark ignited internal combustion engine comprising a fuel delivery path for delivering fuel to a delivery valve, an ignition path for supplying electrical current to a primary electrode of an ignition means; the fuel flow path and the ignition path being in spaced apart relationship and electrically isolated from each other; and a secondary electrode for providing a return to ground, the secondary electrode projecting from the delivery valve in the direction of issuance of fuel spray therefrom.

* * * * *